United States Patent [19]

Catelli

[11] 4,381,067

[45] Apr. 26, 1983

[54] FEEDING DEVICE FOR PRE-STERILIZED OBJECTS CONTAINED IN INTERNALLY STERILE RECEPTACLES, FOR STERILE PACKING PLANTS

[75] Inventor: Camillo Catelli, Parma, Italy

[73] Assignee: Ing, Rossi & Catelli di Catelli & C. S.n.C, Parma, Italy

[21] Appl. No.: 235,740

[22] Filed: Feb. 18, 1981

[30] Foreign Application Priority Data

Feb. 29, 1980 [IT] Italy ..... 40014 A/80

[51] Int. Cl.[3] ..... G01F 11/28

[52] U.S. Cl. ..... 222/450; 141/284; 222/152

[58] Field of Search ..... 222/450, 424.5, 160, 222/442, 152; 141/284, 283, 89, 91, 154, 350, 379–381

[56] References Cited

U.S. PATENT DOCUMENTS

| | | | |
|---|---|---|---|
| 1,442,138 | 1/1923 | Falkiner | 141/284 |
| 2,817,463 | 12/1957 | Stokes | 222/442 |
| 4,212,331 | 7/1980 | Benatar | 141/284 |

FOREIGN PATENT DOCUMENTS

| | | |
|---|---|---|
| 1017454 | 10/1957 | Fed. Rep. of Germany . |
| 2811652 | 3/1978 | Fed. Rep. of Germany . |

*Primary Examiner*—Joseph J. Rolla
*Assistant Examiner*—Kenneth Noland
*Attorney, Agent, or Firm*—Browdy and Neimark

[57] ABSTRACT

The invention concerns a feeding device for pre-sterilized objects contained in internally sterile receptacles, for sterile packing plants. The device substantially comprises a chamber within which a sterile atmosphere is created at a pressure slightly higher than the atmospheric pressure, which communicates, by means of a valve-operated aperture, with a sterile environment into which the objects are to be transferred. The receptacle containing the objects is secured in correspondence with a second aperture in the chamber, a sterile atmosphere is created within the chamber and the lid of the receptacle is removed mechanically. The objects drop to the bottom of the chamber and by acting upon the valve, are transferred to the sterile environment.

8 Claims, 9 Drawing Figures

10
11
4

12
23
15
34
5

15
11

10
10b
1
4a 10
23
4b

FEEDING DEVICE FOR PRE-STERILIZED OBJECTS CONTAINED IN INTERNALLY STERILE RECEPTACLES, FOR STERILE PACKING PLANTS

BACKGROUND OF THE INVENTION

This invention concerns a feeding device for pre-sterilized objects contained in internally sterile receptacles, for sterile packing plants.

During the course of the description, the pre-sterilized objects will be identified as nozzles for closing pressurized cans containing foodstuffs and propellant gas under pressure in order to force the products out of the pressurized can; it is obvious, however, that the different nature of these objects which could consist of various types of lids and caps, twist-off type capsules, etc. does not alter the essence of that which will be described hereunder. In a sterile packing plant for pressurized cans containing whipped cream, the empty can, after passing through a sterilizing tunnel, arrives in a sterile area where the product is introduced into the can, the can itself is closed by means of a nozzle and the can is then charged with propellant gas for the purpose of forcing the product out of the can. These nozzles reach the can closing device in the sterile area after passing through a vibrating device which is also maintained in a sterile atmosphere, and which lines them up neatly on a conveyor and sends them on to the closing device.

The nozzles reach the plant which packs the product, already pre-sterilized and sealed in receptacles which contain large quantities. The inside of the receptacle is sterile as these receptacles are provided with airtight lids.

There is the problem of removing the nozzles from the receptacle and of conveying them to the closing device without having to carry out further sterilization of the nozzles themselves.

The aim of this invention is to resolve the abovementioned problem by providing a feeding device by means of which it is possible to remove the nozzles from the receptacle and dispatch them to the closing device without impairment to their state of sterility.

A further aim of this invention is that of providing a feeding device which is simple, compact and easily adaptable to a sterile packing line.

A further aim of this invention is that of providing a device which does not call for the use of special clothing for the operators in charge of it.

A still further aim of this invention is that of providing a feeding device which guarantees without a doubt that the operations are carried out in a sterile atmosphere.

SUMMARY OF THE INVENTION

These and still further aims are all achieved by the device in question comprising: a chamber provided with two apertures, the first of which connects the chamber, by means of an opening and closing mechanism operated from outside said chamber, with a sterile environment, and the second of which is shaped in such a way that the mouth of the receptacle containing the pre-sterilized objects passes through it, blocking it completely; a first means for creating, within said chamber, an atmosphere of sterile gas at a pressure slightly higher than the atmospheric pressure; a locking means for securing said receptacle in the position in which the mouth of the latter occupies the second aperture; a second means, operated from outside of said chamber for removing the lid of said receptacle when the latter is secured by said locking means; a diaphragm, situated between said first and second aperture for greatly reducing the sectional area of flow towards the outside, of the gas contained in the chamber, when said second aperture is free. Further features and advantages of this invention will appear clearer from the following detailed description of a preferred, but not exclusive embodiment which is given merely by way of example and in no way restrictive, in the annexed drawings.

DESCRIPTION OF THE PREFERRED EMBODIMENTS

Figure 1:
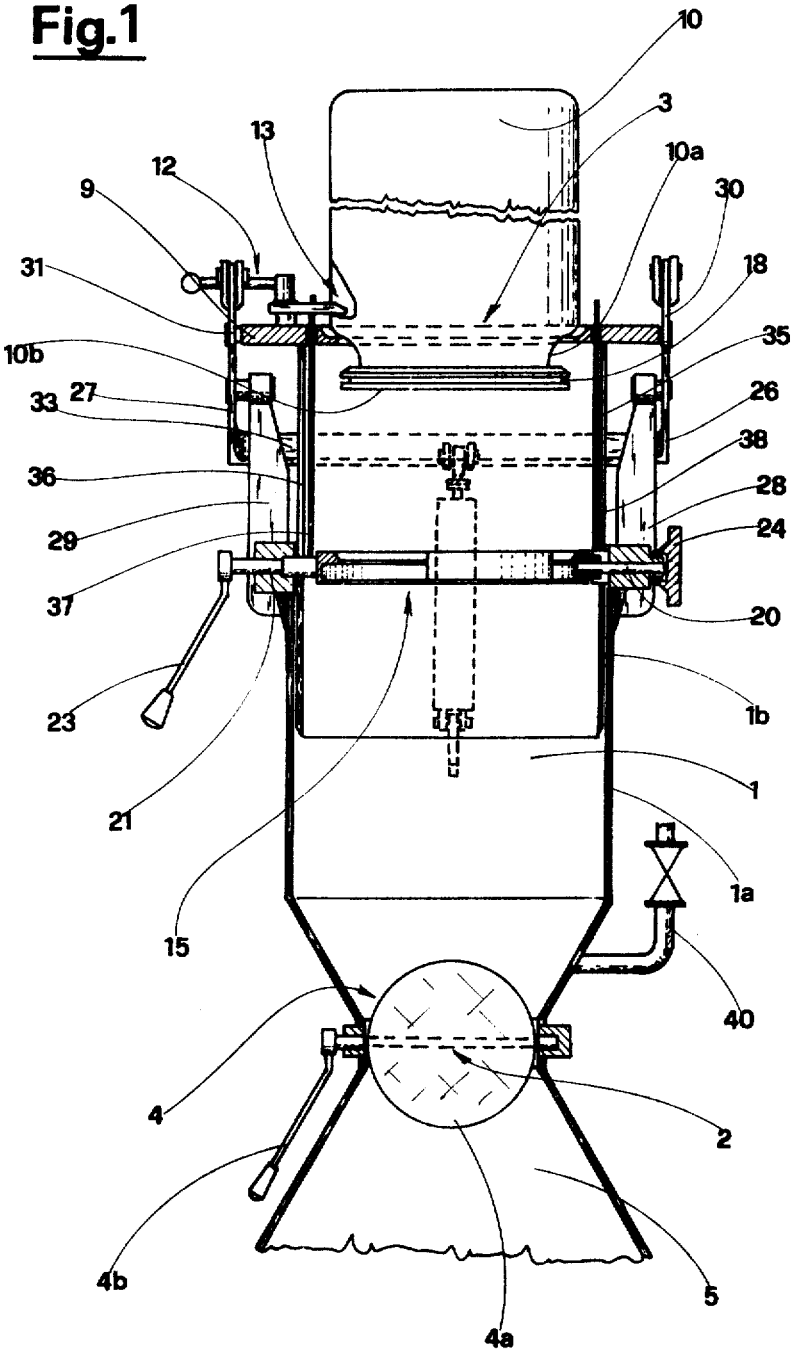
FIG. 1 shows, in vertical elevation, a lengthwise section of the device in question.
Figure 2:
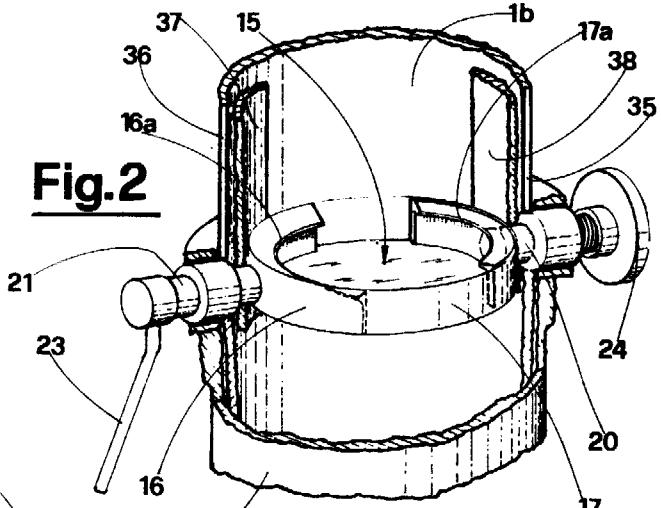
FIG. 2 shows a perspective view of a constructional detail concerning the gripping means of the device in question.
Figure 3:
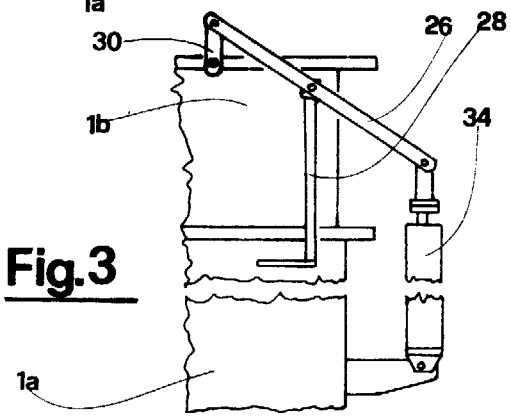
FIG. 3 shows a side view of a constructional detail concerning the mechanisms of the device in question.
Figure 4:
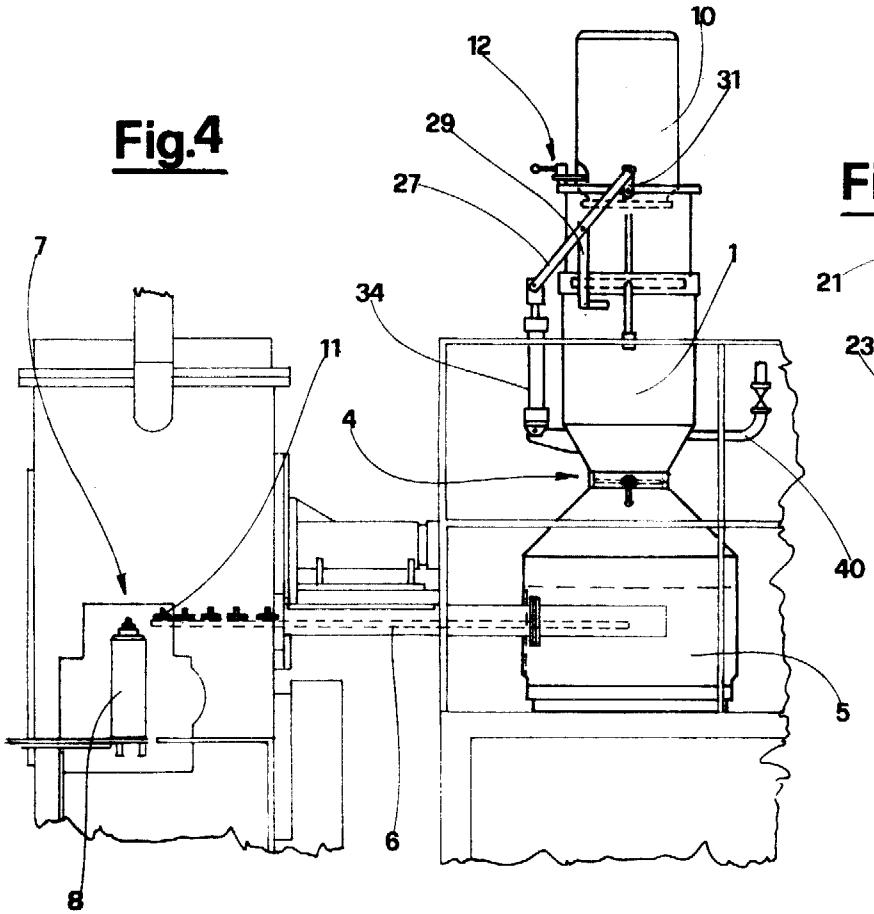
FIG. 4 shows schematically, part of a sterile packing plant using the device in question.

The device illustrated comprises a chamber (1) which, in turn, comprises a first tubular element (1*a*) and a second tubular element (1*b*), arranged coaxially one inside the other and being able to slide axially one with respect to the other. The chamber (1) is provided with a first aperture (2) and a second aperture (3) which are situated, the first aperture (2) on the outer base of the first tubular element and the second aperture (3) on the outer base of the second tubular element. The first aperture (2) has a smaller cross-section with respect to the cross-section of the first tubular element and is provided with an opening and closing mechanism consisting of a butterfly valve (4), the butterfly of which, when in closed position, occupies the entire span of said first aperture. The valve (4) is operated from outside the chamber (1) by manual rotation of a first operating lever (4*b*).

The aperture (2) connects the chamber (1) with a sterile environment (5). A conveyor (6) leads off from the environment (5) which, passing through an internally sterile tunnel, arrives at the filling and sealing area (7) of the pressurized cans (8). A sterile atmosphere is obviously also maintained in the area (7). Integrally fixed to the outer base of the second tubular element is a plate (9) out of which the said second aperture (3) is cut. This aperture (3) is shaped in such a way as to allow the mouth (10*a*) of a receptacle (10) containing the pre-sterilized nozzles (11) to enter it.

The receptacle (10) is secured to the plate (9) by means of a locking means consisting of a clamp (12) which engages with a recess (13) situated on the side of the receptacle (10), in the position in which the mouth of the latter occupies the second aperture (3).

When the receptacle (10) is secured to the plate (9), its mouth blocks the aperture (3) completely and its lid (10*b*) is closed within the chamber (1).

The cross-section of the tubular elements will obviously be such as to easily contain the lid itself.

The tubular elements (1*a*) and (1*b*) are arranged perpendicular to the base and the receptacle (10) is secured coaxially to said tubular elements so that the lid (10*b*) of the receptacle (10), which is of the pressure type, is substantially perpendicular to the common axis of the receptacle and the tubular elements.

The device comprises a second means, operated from the outside of the chamber (1), for removing the lid of the receptacle (10) when the latter is secured to the plate (9) by the clamp (12). This second means, in turn, comprises gripping means, situated within the chamber (1), connected to the first tubular element and operated from outside the chamber itself, for firmly gripping the lid (10*b*) of the receptacle (10) when it is secured to the plate (9), and mechanisms acting upon the second tubular element which push the gripping means and the receptacle together and apart.

The gripping means comprises a frame (15) closed from below, arranged parallel to the surface containing the lid of the receptacle (10) when the latter is secured to the plate (9), and provided with a pair of jaws (16) and (17) situated facing each other. The jaw (16) is integral with the frame whereas the jaw (17) slides in the radial direction of the frame so as to approach and move away from the jaw (16). When the jaws are fully apart, the lid of the receptacle can be inserted between them.

In the device shown in the figures, the lid (10*b*) of the receptacle is provided with an undercut circumferential groove (18) and the jaws (16) and (17) are each provided with a rim (16*a*) and (17*a*) respectively, which extends over an arc of a circle and which is slightly thinner than the depth of the groove (18). Therefore, when the jaws close around the lid, the rims (16*a*) and (17*a*) penetrate into the groove (18) thus permitting the jaws to grip the lid firmly.

A third means, operated from outside the chamber (1) is provided, for causing the rotation of the frame (15) in order to make it assume an inclined position with respect to the axis of the tubular elements or complanate with said axis.

For this purpose the frame (15) is fitted to journals (20) and (21) rotating idle within the housings on the first tubular element (1*a*).

A second operating lever (23) is fitted to the end of the journal (21) which protrudes from the tubular element (1*a*), which is operated manually in order to permit the rotation of the frame (15).

The internal end of the journal (20) is integrally secured to the jaw (17) whilst a threaded nut (24) which engages with a threaded surface fixed with respect to the tubular element (1*a*) is connected, in coincidence with the axial transverse of the journal (20), to its external end.

Thus, rotation of the nut (24) causes the journal (20) to traverse axially, thereby causing the jaw (17) to move towards the jaw (16).

The area occupied by the frame (15), when the latter is arranged perpendicularly to the axis of the tubular elements, is slightly smaller than the area of the cross-section of the chamber (1), therefore there is a small gap between the external perimeter of the frame and the inner wall of the chamber. The frame (15) which is situated between the apertures (2) and (3) therefore constitutes a barrier for greatly reducing the sectional area of flow of the gas contained in the chamber, towards the outside; as it will be more clearly described whilst operating the device, the frame carries out its function of reducing the sectional area of flow of air especially when the aperture (3) is free, that is to say, when the receptacle (10) is not inserted in the latter, insofar as during this phase the frame (15) is perpendicular to the axis of the tubular elements which form the chamber (1).

Said mechanisms comprise a pair of levers (26) and (27) hinged onto rods, (28) and (29) respectively, which are integrally fitted to the first tubular element; the levers (26) and (27) are arranged on opposite sides with respect to the chamber (1) and are substantially parallel to each other.

One end of each lever is connected, by means of a connecting rod (30) and (31) respectively, to the plate (9) of the second tubular element; the other ends of the levers are connected together by means of a crosspiece (33).

A jack (34), the cylinder of which is connected to the first tubular element and the piston of which is connected to the crosspiece (33) causes, on command, the simultaneous rotation of the levers (26) and (27) and thereby, the lowering and raising of the second tubular element.

In order to enable the second tubular element to slide within the first tubular element, the second tubular element is provided with two lengthwise slits (35) and (36) respectively, which can slide on the supports of the journals (20) and (21) supporting the frame (15).

Two metal strips (37) and (38) connected, on one end, to the supports of the journals (20) and (21), are provided inside the chamber (1) to protect the slits (35) and (36); the other end of each metal strip protrudes from appropriate holes in the plate (9). The purpose of the above-mentioned metal strips will be made clearer during the course of the description.

The device in question comprises moreover, a first means for creating an atmosphere of sterile gas within the chamber, at a pressure which is slightly higher than the atmospheric pressure, for purposes which will be explained more clearly during the description of the functioning of the device.

This first means comprises a sterile-air generator, not shown in the figures, which sends sterile air into the area beneath the frame (15) of the chamber (1) through a duct (40).

In order to simplify the description of the functioning of the device, the position in which the second tubular element is partially withdrawn from the first tubular element and the plate (9) is at a distance from the frame (15) will be referred to as first position, and the position in which the second tubular element is inserted into the first tubular element and the plate (9) is close to the frame (15) will be referred to as second position.

A sterile atmosphere is continuously maintained in the environment (5).

During the initial phase, the butterfly valve (4) is closed, the second tubular element is in the second position, the second aperture (3) is free and the frame (15) is situated parallel to the plate (9). There may be external and, therefore, non-sterile air above the frame which enters the aperture (3).

This air does not enter the lower part of the chamber (1) as it is prevented by the frame itself; in fact, the sectional area of flow between the frame and the inner wall of the chamber is such that, due to the overpressure existing within the chamber itself, the flow of air occurs from the lower part of the chamber towards the outside and not vice versa.

Figures 5, 6, 7, 8, 9:
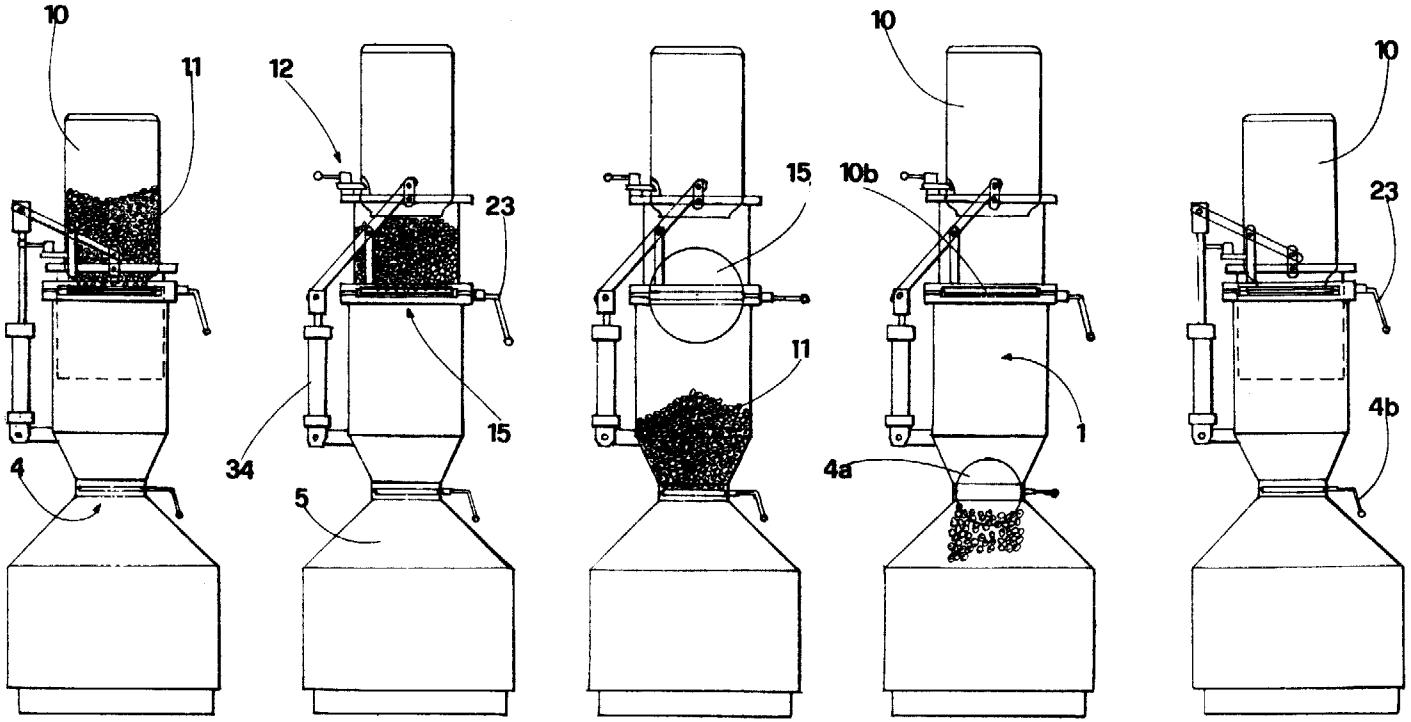
FIGS. 5, 6, 7, 8 and 9 show schematically, various operating phases of the device in question.

The mouth of the receptacle (10) is inserted into the aperture (3) and the receptacle is secured to the plate (9). (FIG. 5). Before inserting the receptacle (10) into the aperture (3), both the lid (10*b*) and the neck of the receptacle, and also the upper part of the frame (15) are thoroughly soaked with sterilizing fluid. This fluid is dried by the sterile air flowing from the inside to the outside of the chamber (1) and is, in any event, in such a position as never to come into contact with the nozzles contained in the receptacle.

The aperture (3) is then blocked by the receptacle (10).

The sterile air which enters the chamber (1) through the duct (40) escapes continuously, due to the slight overpressure in the chamber itself, from the slits (35) and (36) and from the non-perfect seal between the tubular elements, between receptacle (10) and plate (9), etc., thus preventing external air from entering. The first function of the metal strips (37) and (38) is that of preventing an excessive quantity of air from escaping through the slits (35) and (36), which would otherwise call for a considerable flow of sterile air through the duct (40). In the second position, the lid (10*b*) of the receptacle is situated between the jaws of the frame (15). By acting upon the nut (24) the jaw (17) approaches the jaw (16) and the rims (16*a*) and (17*a*) of the jaws fit into the groove (18), thus making the lid (10*b*) integral with the frame (15). The rim (16*a*) of the fixed jaw (16) is able to enter the groove (18) due to the fact that, in closing, the mobile jaw (17) causes slight movement of the receptacle (10). Operating the jack (34) brings the second tubular element into the first position (FIG. 6).

During this operation, the lid (10*b*) which is integral with the frame (15), is removed from the receptacle (10), thus causing the nozzles (11) to fall from the receptacle.

A further function of the metal strips (37) and (38) is that of preventing any nozzles (11) from becoming stuck in the slits (35) and (36).

The raising of the second tubular element must be carried out slowly so as not to cause a rapid increase in the volume in the chamber (1) which would consequently bring about a sharp drop in the pressure within the chamber itself, together with a possible intake of non-sterile external air.

Upon completion of this operation, the lever (23) which causes the rotation of the frame (15) is then turned (FIG. 7), thus causing the nozzles to drop to the bottom of the first tubular element.

This operation does not give rise to the admission of external air into chamber insofar as, during this phase of the operation, the aperture (3) is blocked by the receptacle (10).

The frame (15) is then returned to its original position.

At this point, the butterfly (4*a*) of the valve (4) is turned (FIG. 8) by operating the lever (4*b*), thus permitting the nozzles to enter the sterile environment (5) from whence, through a device not shown in the figures, they will be conveyed, by the means previously described or by other equivalent means, to the sterile area (7) where the pressurized cans (8) will be sealed. The butterfly valve is then re-closed.

The device is returned to the second position (FIG. 9). The clamp (12) is released thus releasing the receptacle (10) which is removed from the plate (9); acting upon the nut (24) the lid, which was held integral with the frame (15), is then released and is removed by hand from the device which is now ready to receive another full receptacle, which is inserted immediately, and to recommence the above-described cycle of operations.

Throughout the entire cycle described, the nozzles are kept continuously in a sterile atmosphere and therefore free from the danger of pollution.

Numerous modifications of a practical applicational nature may be made to the constructional details of the invention, such as for example, all the mechanisms described in this example may be structurally different without however deviating from the sphere of the concept of this invention as claimed hereunder.

What is claimed is:

1. Feeding device for pre-sterilized objects contained in internally sterile receptacles, for sterile packing plants, comprising: a chamber (1) provided with two apertures, the first aperture (2) of which, connects, through an opening and closing mechanism operated from outside said chamber, the chamber itself with a sterile environment (5), and the second aperture (3) of which, is shaped in such a way that the mouth (10*b*) of a receptacle (10) containing the pre-sterilized objects enters it, blocking it completely; a first means for creating a sterile gas atmosphere within the chamber at a pressure slightly higher than atmospheric pressure; a locking means for securing said receptacle in the position in which its mouth occupies said second aperture; a second means operated from outside said chamber, for removing a lid (10*b*) of said receptacle when the latter is locked by said locking means; a diaphragm inserted between said first and second aperture, for greatly reducing the sectional area of flow of the gas contained in the chamber towards the outside, when said second aperture is free.

2. Device as claimed in claim 1, of the type operating with receptacles provided with a pressure-lid, in which said second means comprises: gripping means, contained within said chamber and operated from outside the chamber itself, for firmly gripping the lid of said receptacle when the latter is secured by said locking means; a mechanism for pushing said gripping means and said receptacle together and apart.

3. Device as claimed in claim 2 in which said chamber comprises a first tubular element (1*a*) and a second tubular element (1*b*) arranged coaxially one inside the other and able to slide axially one with respect to the other, said first and second aperture in the chamber being situated respectively on the outer base of said first element and on the outer base of said second element; said gripping means being connected to said first tubular element and said mechanisms acting upon said second tubular element.

4. Device as claimed in claim 3, in which said tubular elements are arranged vertically and said receptacle is locked coaxially to said tubular elements; a third means operated from outside said chamber being provided for causing the rotation of said frame making it assume an inclined position with respect to the axis of said tubular elements or complanate with it.

5. Device as claimed in claims 1, 2 or 3, in which said opening and closing mechanism comprises a pair of levers (26) and (27) hinged to said first tubular element so as to result substantially parallel to each other and arranged on opposite sides with respect to said chamber, one end of each said lever being connected, by means of a connecting rod (30) and (31) respectively, to said second tubular element, the other ends of said levers being connected together by means of a crosspiece (33); a jack (34) being provided, and having a cylinder of which is connected to said first tubular element and the piston of which is connected to said crosspiece.

6. Device as claimed in claim 2, in which said gripping means comprises a frame, closed from below, arranged parallel to the surface containing the lid of said receptacle when the latter is secured by said locking means, equipped with a pair of jaws (16) and (17) arranged facing each other, and able to draw together and move apart, the maximum distance between said jaws being such as to permit the introduction, between the jaws themselves, of the lid of said receptacle; said frame constituting moreover, said diaphragm.

7. Device as claimed in claims 1 or 6, of the type operating with receptacles equipped with lids comprising a circumferential undercut groove (18), in which said jaws are provided with a rim (16*a*) and (17*a*) respectively, extending over an arc of a circle and being slightly thinner than the depth of said groove.

8. Device as claimed in claim 1, in which said opening and closing mechanism comprises a butterfly valve (4) the butterfly (4*a*) of which, when in closed position, occupies the entire span of said first aperture.

* * * * *